United States Patent [19]

Shah

[11] 3,932,170

[45] Jan. 13, 1976

[54] USE OF SCAVENGER IN RECOVERY OF METAL VALUES

[75] Inventor: Ishwarlal D. Shah, Edina, Minn.

[73] Assignee: The United States of America as represented by the Secretary of the Interior, Washington, D.C.

[22] Filed: Aug. 19, 1974

[21] Appl. No.: 498,333

[52] U.S. Cl. ..... 75/7; 75/6; 75/58

[51] Int. Cl.[2] ..... C22B 1/02

[58] Field of Search ..... 75/1, 7, 21, 23, 26, 34, 75/58, 72, 101, 6

[56] References Cited

UNITED STATES PATENTS

| | | | |
|---|---|---|---|
| 2,495,225 | 1/1950 | Buehl | 75/6 |
| 2,577,764 | 12/1951 | Hulme | 75/58 |
| 3,393,066 | 7/1968 | Mayer | 75/34 |
| 3,619,171 | 11/1971 | Bakkerus | 75/58 |
| 3,716,352 | 2/1973 | Ooi | 75/58 |

*Primary Examiner*—Peter D. Rosenberg
*Attorney, Agent, or Firm*—Gersten Sadowsky; Donald R. Fraser

[57] ABSTRACT

Sulfide ores are reduced directly to metallic values such as nickel, copper and iron, by use of a scavenger such as calcium oxide to combine with the sulfur and prevent sulfurous gas from escaping into the atmosphere. The separate metals, copper, nickel and iron can then be recovered as by leaching.

4 Claims, No Drawings

USE OF SCAVENGER IN RECOVERY OF METAL VALUES

BACKGROUND OF THE INVENTION

1. Field of the Invention

This invention relates generally to methods for the recovery of metal values from sulfide ores by reduction and more particularly, to the use of scavengers to combine with the sulfur in conducting the reduction procedures and reducing air pollution.

2. Description of the Prior Art

The metal industries are finding it very difficult to meet the air pollution regulations and standards promulgated by federal and state agencies within the last few years. The use of conventional pyrometallurgical processes in the production of metals from sulfide ore concentrates results in the emission of suspended particulate matter and sulfur oxides. Of these air contaminants, it has been found that sulfur oxides are much more difficult to control. Sulfur oxide emissions result from the smelting of sulfur-bearing materials. For example, copper exists in various other forms in nature, such as native copper and copper oxides, carbonates and silicates, but the primary sources of copper exist as low-grade deposits of copper sulfide ores in which the principal copper mineral is chalocopyrite, and which in most instances also contain some iron sulfide.

In an effort to comply with sulfur oxide air pollution regulations, the metal companies have initiated research programs to develop methods for recovering the sulfur oxides being emitted from their smelters. So far, however, no economical method for reducing sulfur oxide emissions to acceptable levels has been reported.

While the metal industry is making an all-out effort to develop an economical method to control sulfur oxide emissions so as to comply with present regulations and standards, there is an ever-increasing demand from the public for further improvement in the quality of the nation's atmosphere. This is resulting in the promulgation of even more restrictive regulations and standards. The continuation of this trend of more restrictive standards may eventually result in the metal producers finding it economically unfeasible, if not technically impossible, to comply with these standards.

Most proposed methods for controlling sulfur dioxide, the major sulfur oxide contaminant, contemplate the conversion of sulfur dioxide to sulfuric acid. However, even if an economically feasible method is found for converting substantially all the sulfur dioxide to sulfuric acid, the disposal of large amounts of sulfuric acid presents another pollution problem.

In their combined state, metals such as copper, nickel and iron are usually chemically combined in the ores with non-metallic elements such as sulfur and oxygen. In winning these latter metals from their ores it usually is necessary to perform a reduction operation where the anions or non-metallic elements such as oxygen, sulfur, etc. which have a negative charge, are separated from the cation metal constituent which has a positive charge. In the reduction process, the metal is separated from the oxygen or sulfur by virtue of the combination of the oxygen or sulfur with reducing gas and by virtue of the diffusion or migration of the metal ions. The rate at which reducing gas combines with the non-metallic elements, sulfur and oxygen, can be controlled by controlling the pressure, temperature, rate of the flow of reducing gas, composition of the local gas phase and surface area of the solid.

Of particular interest in processes of this type is the recovery of metals such as nickel and copper which are extremely valuable. The United States leads the free world in nickel consumption, about 30%, while producing less than 3.3% of the free world nickel output. This imbalance provides enouh impetus to explore the possibilities of obtaining nickel from the various sulfide ores such as Duluth Gabbro, the largest nickel sulfide ore body in the United States, and copper from ores such as chalcopyrite and the like.

The specific present day procedure for extracting nickel and copper from sulfide ores involves an initial roasting operation in which the sulfur level of the concentrate is adjusted to an optimum level for smelting operation. In the smelting operation, a copper-nickel-iron matte is produced, which matte is then blown to white metal in a converter by selective oxidation of iron sulfide and its removal in the form of a slag. Thereafter, the white metal is annealed over a period of several days to promote differential crystallization. This results in a separation of copper and nickel sulfides. The nickel sulfide and copper sulfide are then separated by flotation and the nickel sulfide product is processed further by roasting or electrolytic refining and marketed as NiO or Ni.

The present day procedure for extracting copper from sulfide ores involves preliminary roasting for partial elimination of sulfur contained in the copper concentrate followed by smelting in a reverberatory furnace to concentrate copper into matte, followed by conversion or Bessemerization of matte to blister copper which is then cast into anodes for electrolytic refining.

These procedures involve many steps and a substantial possibility is inherent in these processes for pollution of the atmosphere by $SO_2$. Under the present environmental restrictions and regulations, it is highly desirable that there be provided procedures which will simplify the operations by which nickel, copper and other metals are recovered from sulfide slags and also to provide a process which will not pollute the atmosphere in its operation.

SUMMARY OF THE INVENTION

It is accordingly one object of this invention to provide a method for the extraction of nickel and copper from sulfide ores which overcome or otherwise mitigate disadvantages of the prior art.

A further object of the invention is to provide a method for the reduction of sulfide ores directly to metallic values in one step wherein pollution of the atmosphere by sulfur dioxide evolution is minimized.

A still further object of the invention is to provide a method for the reduction of sulfide ores directly to metallic values in one step wherein a scavenger material is used to combine with the sulfur and thus prevent sulfurous gas from escaping into the atmosphere.

Other objects and advantages of the present invention will become apparent as the description thereof proceeds.

In satisfaction of the foregoing objects and advantages, there is provided by this invention a method for the reduction of sulfide ores directly to metallic values which comprises contacting an ore such as Duluth Gabbro or chalcopyrite concentrate with a reducing agent such as hydrogen or carbon monoxide or mixture thereof at a temperature of from 600°–1,000°C. in the presence of a scavenging agent comprising an alkaline earth oxide, hydroxide, carbonate, or mixture thereof, the amount of scavenging agent present being sufficient to combine with all the sulfur present in the ore, separating the sulfide products and recovering the metallic values.

DESCRIPTION OF PREFERRED EMBODIMENTS

As indicated, the process of this invention is concerned with the recovery of valuable metallic values such as nickel and copper from ores which contain sulfur and in which these metallic values are present in combined form. Particularly suitable ores for use in this invention include pentlandite (a sulfide of iron and nickel), gabbro float concentrate and chalcopyrite concentrate. On reduction, the pentlandite provides an iron-nickel alloy, the gabbro float concentrate after reduction roasting and magnetic separation, yields a magnetic concentrate containing most of the nickel and copper in metallic form, and the chalcopyrite ($CuFeS_2$) concentrate yields metallic copper and iron. Mixtures of ores may also be used as starting materials as well as other ores such as covellite (CuS), chalcocite ($Cu_2S$), bornite ($CU_5FeS_4$), enargite, tetrahedite, tennantite and the like. Other ores not specifically mentioned which contain the metallic values in question can also be used.

According to this invention, it has been found that valuable nickel, copper and iron values can be extracted from sulfide ores of these types by reduction where, in the process, there is employed a scavenger in sufficient amounts to react with and thus combine with the sulfur liberated during the extraction procedure. The use of the scavenger results in the substantial elimination of air pollution in conducting the extraction processes and also yields a higher quality metallic extract from which the metals can be easily recovered by conventional means.

According to the present invention, the scavengers which may be used in the process comprise alkaline earth metal derivatives, in particular the alkaline earth metal oxides, hydroxides, carbonates and bicarbonates. Calcium oxide, calcium hydroxide, magnesium oxide, magnesium hydroxide, calcium carbonate, magnesium carbonate and mixtures thereof are particularly preferred for use in the process of this invention. A sufficient amount of the scavenger agent is utilized in the process to react with all the sulfurous gas which is produced in the reduction process or sufficient scavenging agent to combine with the sulfur present in the starting ore. As a practical matter, sufficient scavenger should be used to combine with all the sulfur calculated to be theoretically present in the starting ore.

It has been found that use of the scavenger or sulfide-acceptor material in the reduction process of this invention provides a number of advantages. It eliminates a number of the steps required in the prior art and also prevents sulfur from escaping into the atmosphere. Further, it provides procedures by which all the metallic elements present, particularly copper, nickel and iron, may be recovered. Moreover, the scavenger enhances the rate and extent of recovery of these metals as the addition of the acceptor or scavenger has been found to enhance the rate and extent of sulfide reduction of the concentrate to obtain metallic values. The scavenger or acceptor reacts with the sulfides during the reaction to form alkaline earth sulfides which thereby minimizes the escape of sulfurous gas to the atmosphere.

The reaction is carried out by contacting the ore with a gaseous reducing agent at a temperature of from about 600°–1,000°C. Reducing agents for general use in processes of this type include hydrogen, which is ordinarily used, carbon monoxide and the like. While the reducing agent is usually hydrogen, there may also be used a combination of hydrogen with other reducing gases at any desired pressure. Under these conditions, reduction of the ore takes place with the evolution of sulfurous gases containing sulfur usually in the form of sulfur dioxide, hydrogen sulfide, or mixtures.

As indicated above, the scavenging agent is preferably mixed with the ore or ore concentrate at the beginning of the reaction in sufficient amounts to combine with all the sulfur theoretically present in the ore or concentrate. The starting material may be in the form of powder or pellets for initiation of the reaction. Any desired apparatus may be employed, including those well known to the art, which will be suitable for obtaining good mixing of the reducing gas and for withstanding the high temperatures used in the presence of the corrosive materials present. Generally in this invention it is highly preferred to use a horizontal resistance furnace or graphite-lined rotary stainless steel drum for conducting the reaction. Apparatus of this type are well known to the art and need not be further described here.

After the basic procedure of contacting the ore with the reducing agent in the presence of the scavenging agent, the metallic products are then generally preferably separated by magnetic separation in order to isolate them from the oxides and sulfides contained in the mixture. Where mixtures of metallic values are obtained, they may be separated from each other by leaching which is a well known metallurgical procedure for the separation of metals and ores.

As indicated, when mixtures of metallic values are obtained, leaching procedures may be carried out to effect final separations. The leaching operations may be conducted by any of the methods well known to those skilled in the art such as those set forth, for example, in U.S. Pat. Nos. 2,563,623, 3,574,599 and 3,785,944. Generally the leaching step may be carried out by mixing the product from the reducing or magnetic separation step with ammonia solution or an acid such as HCl or $H_2SO_4$, usually in the form of aqueous solution. The resulting leach solution is then treated further to effect precipitation of the metal values for recovery by filtration.

The theory of operation of this process is that it operates to enhance thermodynamically the rate and extent of the reduction process to completion by lowering the activity of product sulfurous gas, such as $H_2S$, by capturing it with the scavenger, such as CaO. It is well known of course that thermodynamics is an important tool in defining the limits of a process as the knowledge of physical and kinetic parameters, along with the thermodynamics, are required to judge the feasibility of a process.

In general, the hydrogen reduction of metal sulfides is quite unfavorable, but the addition of a scavenging agent, such as CaO for sulfurous gas, results in a favorable thermodynamics for hydrogen reduction of several metal sulfides. This can be easily explained by thermodynamics consideration of the hydrogen reduction of cuprous sulfide with and without additions of CaO at 1,000°K.

$$CaO + H_2S = CaS + H_2O;\ \Delta F_1^\circ = -14{,}780\ cal/mol \quad (1)$$
$$Cu_2S + H_2 = 2Cu + H_2S;\ \Delta F_2^\circ = 14{,}300\ cal/mol \quad (2)$$

Combination of reactions (1) and (2) gives:

$$CaO + Cu_2S + H_2 \rightarrow CaS + 2Cu + H_2O;\ \Delta F_{1+2}^\circ = -480\ cal/mol \quad (1+2)$$

Free energy values of reactions (1), (2) and (1+2) imply that reaction (1) is most favorable, reaction (2) is unfavorable and reaction (1+2) is slightly favorable.

Equilibrium constants $K_1=(P_{H_2O}/P_{H_2S})$, $K_2=(P_{H_2S}/P_{H_2})$ and $K_{1+2}=(P_{H_2O}/P_{H_2})$ calculated from reaction:

$$\Delta F^\circ = -RT\ ln\ K$$

are $1.7 \times 10^3$, $7.6 \times 10^{-4}$ and 1.1, respectively. Low equilibrium constant $K_2=P_{H_2S}/P_{H_2} = 7.6 \times 10^{-4}$ imposes a severe kinetic limitation on reduction because hydrogen sulfide must be transported out of the system at concentrations of only a few hundred ppm. Only extremely high gas flow rates may be able to reduce the metal sulfide. The addition of CaO to $Cu_2S$ gives an equilibrium constant of $K_{1+2} = P_{H_2O} = 1.1$ for the hydrogen reduction of $Cu_2S$. The chemical driving force for reduction (1+2) will be inversely proportional to $P_{H_2O}$ and $P_{H_2O}$ can be lowered to a required level by flowing $H_2$ gas fast enough through the system so that the sulfide reduction to metal will occur and at the same time the metal oxidation will be avoided. From this example, one can conclude that the addition of scavenger, such as CaO, will make hydrogen reduction of any metal sulfide possible as far as $\Delta F_1^\circ + \Delta F_2^\circ \leq 0$. From a practical point of view, if hydrogen is flowing fast enough to drive most of $H_2O$ out of the systems then $H_2$ reduction of any metal sulfide should be feasible even if $\Delta F_1^\circ + \Delta F_2^\circ$ is slightly positive.

The following examples are presented to illustrate the invention but it is not considered as limited thereto. In the examples and throughout the specification parts are by weight unless otherwise indicated.

EXAMPLE 1

A laboratory horizontal resistance furnace, and graphite-lined rotary stainless steel drum were used for the reduction experiments. Five grams of pentlandite were mixed with equal amounts of $Ca(OH)_2$ and heated in various $H_2$-He mixtures from 1 to 24 hours in a tube furnace. CaO and CaS were removed from the product by magnetic separation and the final product contained mainly Fe-Ni alloy or metallic copper and iron. Copper and iron were separated from each other by leaching.

EXAMPLE 2

A laboratory horizontal resistance furnace, and graphite-lined rotary stainless steel drum were used for the reduction experiments. Five grams of chalcopyrite were mixed with equal amounts of $Ca(OH)_2$ and heated in various $H_2$-He mixtures from 1 to 24 hours in a tube furnace. CaO and CaS were removed from the product by magnetic separation and the final product contained, mainly, Fe-Ni alloy or metallic copper and iron. Copper and iron were separated from each other by leaching.

EXAMPLE 3

Fifty-two grams of gabbro concentrate are mixed with 22.5 grams of $Ca(OH)_2$ and placed, in the form of a powder, in a graphite-lined rotating stainless steel drum. Reducing gas, $H_2$, was passed through the drum and heated for several hours in the range of 600° to 900°C. in a muffle furnace. The roast product is subjected to magnetic separation in a Davis tube. The magnetic concentrate contained most of the metallic values.

EXAMPLE 4

Twenty-five grams of chalcopyrite concentrate are mixed with 25 grams of $Ca(OH)_2$ and placed, in the form of pellets, in a graphite-lined rotating stainless steel drum. Reducing gas, (CO) is passed through the drum and heated for several hours in the range of 600° to 900°C. in a muffle furnace. The roast product is subjected to magnetic separation in a Davis tube. The magnetic concentrate contained most of the metallic values.

The following Table I shows the effect of CaO on the pentlandite reduction in $H_2$ flowing at 500 cc/min. Here CaO and CaS were removed by dissolving the product in 5 percent acetic acid. X-ray analysis showed that the final product in Examples 7 and 8 was mainly iron-nickel (1:1) alloy.

TABLE I

Effect of lime on the reduction of pentlandite for 3 hours in $H_2$ at 500 cc/min

| EXAMPLE | SAMPLE | TEMP°C. | WEIGHT PCT. SULFUR IN REDUCED PENTLANDITE |
|---|---|---|---|
| 5 | Pentlandite (Theory-Maximum S-36%) | 750 | 23.0 |
| 6 | Pentlandite | 800 | 15.2 |
| 7 | Pentlandite+$Ca(OH)_2$ | 750 | 0.21 |
| 8 | Pentlandite+$Ca(OH)_2$ | 800 | 0.81 |

The following Table II shows the effect of CaO additions to chalcopyrite reduction in $H_2$ flowing at 1,300 cc/min at 800°C. CaO and CaS were removed from the product by magnetic separation. X-ray results showed the presence of $Cu_{2-x}S$, $Fe_{1-x}S$, and some metallic Cu and Fe in Examples 9 and 10, while in Examples 11 and 12, the product contained merely metallic Cu and Fe. This observation is confirmed by the presence of a large amount of sulfur in Examples 9 and 10, compared with the remaining tests.

TABLE II

Effect of lime on the reduction of chalcopyrite in $H_2$ (1,300 cc/min) at 800°C.

| EXAMPLE | MATERIAL | REDUCTION TIME IN HOURS | CHEMICAL ANALYSIS OF THE PRODUCT | | |
|---|---|---|---|---|---|
| | | | Fe | Cu | S |
| 9 | Chalcopyrite | 1 | 39.25 | 36.72 | 22.13 |
| 10 | Chalcopyrite | 7 | 40.04 | 43.67 | 15.09 |
| 11 | Chalcopyrite + $Ca(OH)_2$ | 1 | 44.12 | 47.83 | 3.57 |
| 12 | Chalcopyrite + $Ca(OH)_2$ | 2 | 45.27 | 49.60 | 2.08 |

The following Table III shows the effect of lime on the reduction of bulk gabbro flotation concentrate in $H_2$ at 600° to 900°C. X-ray analysis of the magnetic concentrate showed the metallic values of the ores were mainly present as sulfides in Example 13, while in Examples 14 and 15 the iron, copper and nickel were mainly present as metallic iron, metallic copper and iron-nickel alloy, respectively. The beneficial effect of lime at 900° and 600°C. is evident from the chemical analysis.

TABLE III

Percent Magnetic grade and recovery of bulk-gabbro concentrate* roasted for 2 hours

| | ROAST CONDITIONS | | CHEMICAL ANALYSES, PERCENT | | | | | | RECOVERY, PERCENT | | | | | |
|---|---|---|---|---|---|---|---|---|---|---|---|---|---|---|
| EXAMPLE | T°C | REDUCTANT | Ni | Cu | Fe | S | $SiO_2$ | $Al_2O_3$ | Ni | Cu | Fe | S | $SiO_2$ | $Al_2O_3$ |
| 13 | 900 | $H_2$ | 5.2 | 8.9 | 34.8 | 10.4 | 19.6 | 6.2 | 85.3 | 31.5 | 32.4 | 31.1 | 9.3 | 9.6 |
| 14 | 900 | $H_2$-CaO | 4.5 | 17.6 | 44.0 | <0.5 | 15.2 | 5.1 | 90.0 | 85.0 | 50.0 | <1.0 | 7.0 | 8.3 |
| 15 | 600 | $H_2$-CaO | 4.8 | 22.4 | 55.0 | 2.3 | 6.3 | 1.6 | 82.9 | 81.0 | 50.0 | 4.4 | 2.7 | 3.0 |
| *Head analysis of bulk concentrate | | | 0.9 | 4.2 | 17.1 | 7.2 | 35.6 | 10.5 | | | | | | |

The invention has been described herein with reference to certain preferred embodiments. However, as obvious variations thereon will become apparent to those skilled in the art the invention is not to be considered as limited thereto.

What is claimed is:

1. A method for the reduction of metal sulfides selected from the group consisting of copper, iron and nickel sulfides and mixtures thereof to obtain an elemental metal without production of volatile sulfur compounds which comprises:

mixing the metal sulfide with a compound reactive with sulfur, said compound selected from the group consisting of alkaline earth oxides, alkaline earth hydroxides, alkaline earth carbonates and mixtures thereof, the amount of said compound being at least sufficient to combine with all of the sulfur contained in said metal sulfide to form an alkaline earth sulfide which is stable at the reaction conditions;

contacting the mixture with a reducing gas selected from the group consisting of hydrogen, carbon monoxide and mixtures thereof at a temperature in the range of 600° to 1000°C but below the melting point of any of the components of the mixture for a time sufficient to convert substantially all of the metal content of the metal sulfides to the elemental state, and separating elemental metal from the other components of the mixture.

2. A method according to claim 1 wherein the reduction reaction is carried out for about 1 to 24 hours.

3. A method according to claim 1 wherein the reducing gas is hydrogen.

4. A method according to claim 3 wherein the scavenger is $Ca(OH)_2$.

* * * * *